US010427015B2

(12) United States Patent
Balest

(10) Patent No.: US 10,427,015 B2
(45) Date of Patent: Oct. 1, 2019

(54) ADJUSTABLE LOFT GOLF CLUB HEAD

(71) Applicant: Joseph Balest, Cortland, OH (US)

(72) Inventor: Joseph Balest, Cortland, OH (US)

(73) Assignee: Ringertown Innovations, LLC, Akron, OH (US)

( * ) Notice: Subject to any disclaimer, the term of this patent is extended or adjusted under 35 U.S.C. 154(b) by 482 days.

(21) Appl. No.: 15/208,834

(22) Filed: Jul. 13, 2016

(65) Prior Publication Data

US 2017/0203168 A1 Jul. 20, 2017

Related U.S. Application Data

(60) Provisional application No. 62/279,278, filed on Jan. 15, 2016.

(51) Int. Cl.
*A63B 53/04* (2015.01)
*A63B 53/06* (2015.01)

(52) U.S. Cl.
CPC ..... *A63B 53/065* (2013.01); *A63B 53/0487* (2013.01); *A63B 2053/0416* (2013.01)

(58) Field of Classification Search
CPC ..... A63B 2053/022; A63B 2053/023; A63B 2053/026
See application file for complete search history.

(56) References Cited

U.S. PATENT DOCUMENTS 1,644,177 A * 10/1927 Collins ..... A63B 53/06 473/247
1,713,158 A * 5/1929 Anderson ..... A63B 53/06 473/247
1,983,196 A * 12/1934 Spiker ..... A63B 53/06 473/247
2,305,270 A * 12/1942 Nilson ..... A63B 53/06 473/247
2,455,150 A * 11/1948 Verderber ..... A63B 53/06 473/247
2,475,926 A * 7/1949 Verderber ..... A63B 53/06 473/247
2,495,444 A * 1/1950 Chamberlain ..... A63B 53/06 473/247
2,520,701 A * 8/1950 Verderber ..... A63B 53/06 473/247
2,520,702 A * 8/1950 Verderber ..... A63B 53/06 473/247
2,571,970 A * 10/1951 Verderber ..... A63B 53/06 116/315
2,777,694 A * 1/1957 Winter ..... A63B 53/06 473/247
2,847,219 A * 8/1958 Shoemaker ..... A63B 53/06 473/247
2,882,053 A * 4/1959 Lorthiois ..... A63B 53/06 473/245

(Continued)

*Primary Examiner* — William M Pierce
(74) *Attorney, Agent, or Firm* — Buckingham, Doolittle & Burroughs, LLC

(57) ABSTRACT

A golf putter club head that is adjustable in loft. A face component with a blade adjustably engages a housing component that is attachable to a golf club shaft. At least one of a plurality of adjusting components is engaged to adjust the loft of the blade relative to the housing component. A securing component is engaged to temporarily fix the loft by securing the face component to the housing component.

19 Claims, 11 Drawing Sheets

(56) References Cited

U.S. PATENT DOCUMENTS 2,962,286 A * 11/1960 Brouwer ..... A63B 53/06 473/247
3,214,169 A * 10/1965 Rupnow ..... A63B 53/06 473/246
3,601,399 A * 8/1971 Agens ..... A63B 53/06 473/247
3,791,647 A * 2/1974 Verderber ..... A63B 53/06 473/247
4,195,842 A * 4/1980 Coleman ..... A63B 53/04 473/337
4,778,180 A * 10/1988 Guenther ..... A63B 53/065 473/244
5,133,553 A * 7/1992 Divnick ..... A63B 53/06 473/245
5,228,689 A * 7/1993 Donofrio, Sr. ..... A63B 53/06 473/245
5,390,918 A * 2/1995 Meyers ..... A63B 53/065 473/246
5,390,919 A * 2/1995 Stubbs ..... A63B 53/065 473/246
5,393,056 A * 2/1995 Richardson ..... A63B 53/06 473/247
5,413,337 A * 5/1995 Goodman ..... A63B 53/06 473/247
5,538,245 A * 7/1996 Moore ..... A63B 53/06 473/239
5,749,790 A * 5/1998 Van Alen, II ..... A63B 53/02 473/245
6,149,533 A * 11/2000 Finn ..... A63B 53/02 473/336
6,206,788 B1 * 3/2001 Krenzler ..... A63B 53/02 473/245
6,348,009 B1 * 2/2002 Dischler ..... A63B 53/02 473/247
6,435,976 B1 * 8/2002 Galliers ..... A63B 53/02 473/244
6,514,154 B1 * 2/2003 Finn ..... A63B 53/02 473/306
7,410,423 B2 * 8/2008 Pinder ..... A63B 53/02 473/244
7,429,218 B2 * 9/2008 Pinder ..... A63B 53/02 473/244
9,901,792 B2 * 2/2018 Franklin ..... A63B 53/04
9,950,219 B2 * 4/2018 Larson ..... A63B 53/0466
10,046,211 B2 * 8/2018 Franklin ..... A63B 53/0487
2003/0008723 A1 * 1/2003 Goodman ..... A63B 53/02 473/246
2007/0161430 A1 * 7/2007 Bardha ..... A63B 53/0487 473/244
2014/0378243 A1 * 12/2014 Sanyal ..... A63B 53/065 473/313
2015/0031468 A1 * 1/2015 Matsunaga ..... A63B 53/0466 473/299
2015/0080143 A1 * 3/2015 Sanyal ..... A63B 53/06 473/248
2015/0231454 A1 * 8/2015 Parsons ..... A63B 53/0475 473/335
2015/0265884 A1 * 9/2015 Yeh ..... A63B 53/02 473/314
2016/0193508 A1 * 7/2016 Issertell ..... A63B 53/047 473/342
2017/0203168 A1 * 7/2017 Balest ..... A63B 53/065
2017/0239535 A1 * 8/2017 Brandt ..... A63B 53/0487
2017/0361179 A1 * 12/2017 Brandt ..... A63B 53/0487
2018/0104554 A1 * 4/2018 Sanyal ..... A63B 53/065
2018/0117425 A1 * 5/2018 Taylor ..... A63B 53/02

* cited by examiner

ADJUSTABLE LOFT GOLF CLUB HEAD

CROSS-REFERENCE

This application claims priority from Provisional Patent Application Ser. No. 62/279,278 filed Jan. 15, 2016.

FIELD OF THE INVENTION

This invention pertains generally to an adjustable loft golf club head, and more particularly to an adjustable loft golf putter head that permits a user to increase or decrease the loft of the putter to match the putting style of the player and to adjust to the type of grass used by a particular golf course.

BACKGROUND

In the game of golf, a putter is generally the club of choice once the ball lands on or near the green. The green is a putting surface that surrounds the hole where the grass is closely mown to create a relatively smooth surface. While in golf vernacular the putter is known as the "flat stick," that is not necessarily an accurate description. Almost every putter has some degree of loft built into the face. This loft is necessary because even on the fastest of greens, the ball sits or rests slightly down in the grass and not level with the surface. Loft is necessary to lift the ball out of that slight depression in the grass and get it rolling as quickly as possible. The proper loft for the type of grass and the player's style contributes greatly to the quality and speed of the roll.

When viewing a close-up of golf balls rolling on greens, it is very apparent that there are marked differences between puts. Some puts track with a desirable tight end-over-end roll while others wobble as they roll. While the angle of the club face at impact and the proximity to the club's "sweet spot" contribute to roll, the most important variable to attaining a tight roll is the loft of the putter face at impact. During a put the club head approaches the ball at a much lower speed than most other golf shots. The impact of the face with the ball lasts approximately 0.5 milliseconds. The loft of the putter lifts the ball off of the surface of the green and imparts a small amount of back spin. The ball remains in flight for up to several inches before it lands back on the green. The ball then generally skids for several inches before finally taking on its true roll. Therefore, the loft of the club at impact as opposed to the built-in putter loft is the critical factor. Since the impact only lasts approximately 0.5 milliseconds, this is difficult to observe precisely without sophisticated equipment.

Consistency in putting requires a smooth even backswing and downswing through impact with the ball. Players with too little loft on their putters tend to subconsciously compensate by hitting up on the ball to increase the loft at impact. Other players with too much club loft tend to hit down on the ball to decrease loft on impact. This compensation leads to inconsistency in putting as it is difficult to repeat consistently. Additionally, greens made of grasses such as Bermuda grass tend to be thicker than other grasses requiring a greater loft to adequately hit the ball out of the deeper depression.

Consequently, there exists a need for an adjustable golf putter that allows a player to adapt the club to his particular swing and the different variety of grasses used on golf greens. Without the need for additional putter clubs or expensive monitoring equipment, the present invention allows a player to easily adjust his putter to fit his particular stance and style. The invention is useable with short and long golf shafts further enhancing the adjustability. Furthermore, the club head is adjustable for any type of putting surface.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an adjustable golf club head. The adjustable golf club head comprises a housing component, a face component, a plurality of adjusting components, and a securing component. The face component is adjustably attachable to the housing component with the plurality of adjusting components. Once adjusted, the face component is securable to the housing component with the securing component.

Furthermore, in a preferred embodiment of the invention, the adjustable golf club head comprises a housing component, a face component, a plurality of adjusting components, a securing component, and further comprises a cylinder component. The cylinder component adjustably connects the face component to the housing component. The plurality of adjustable components rotates the cylinder component within the housing, thereby changing a loft of the face component as the cylinder component is rotated.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
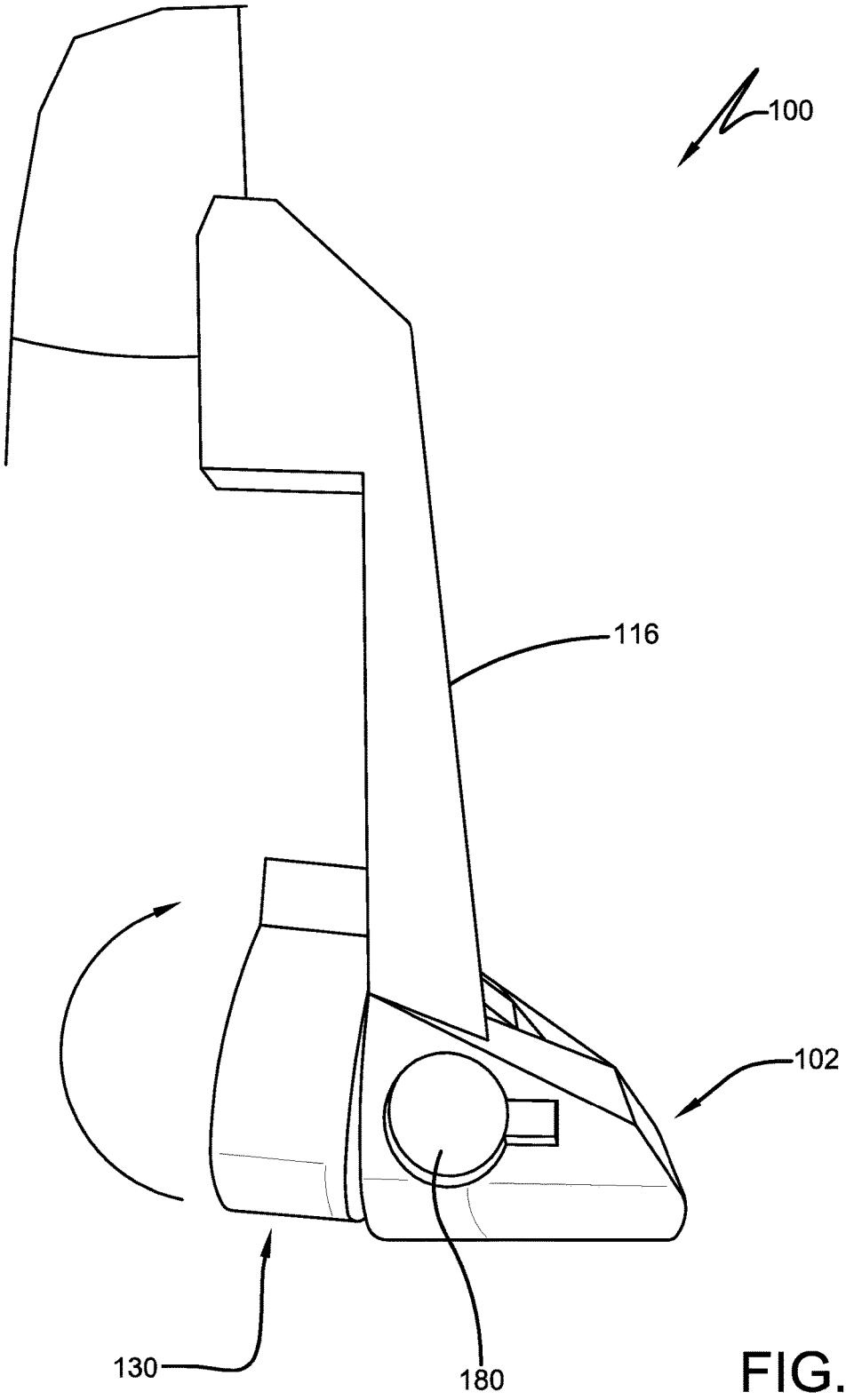
FIG. 1 illustrates a perspective view of a golf club head in accordance with the disclosed architecture.
Figure 2:
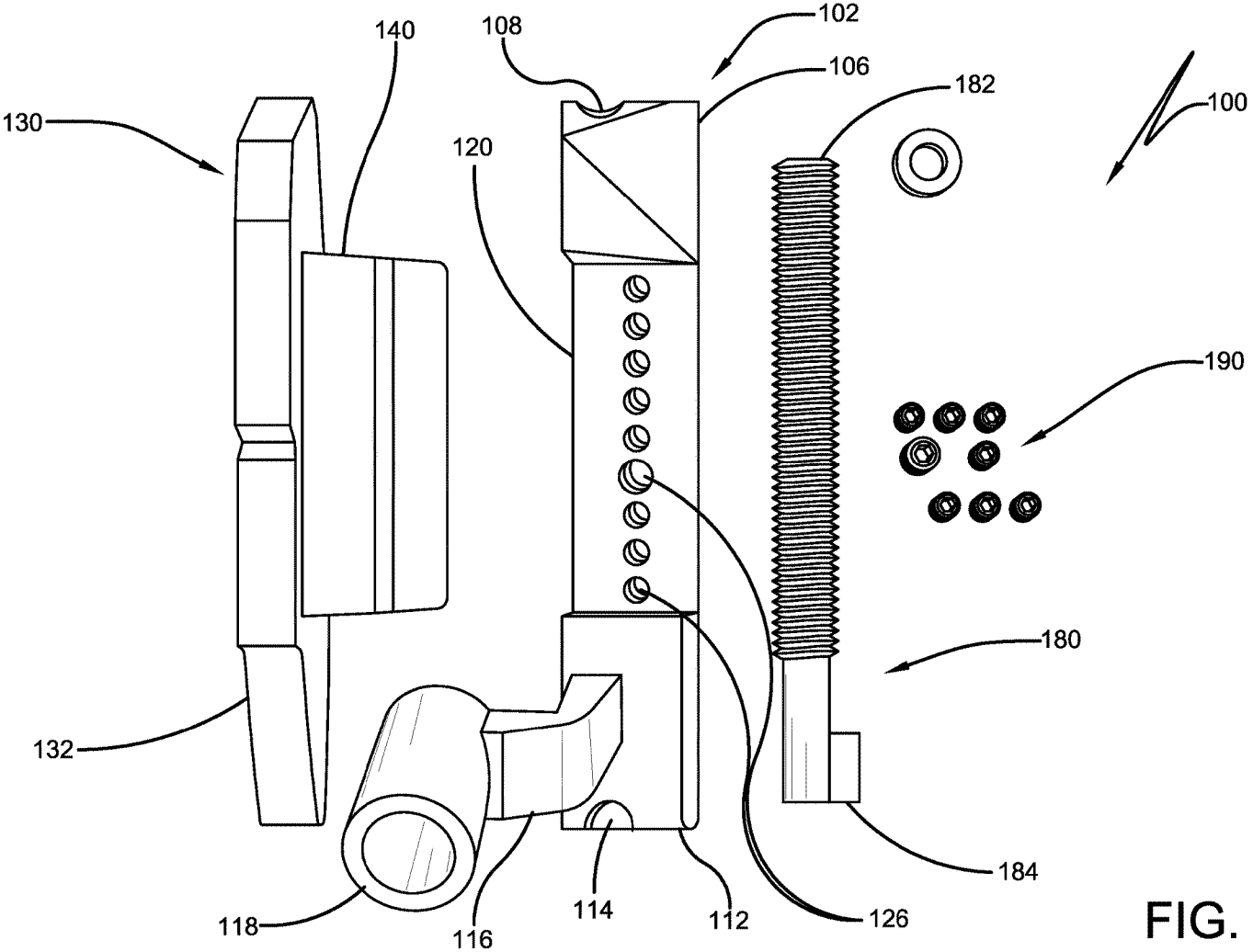
FIG. 2 illustrates an exploded view of the golf club head in accordance with the disclosed architecture.
Figure 3:
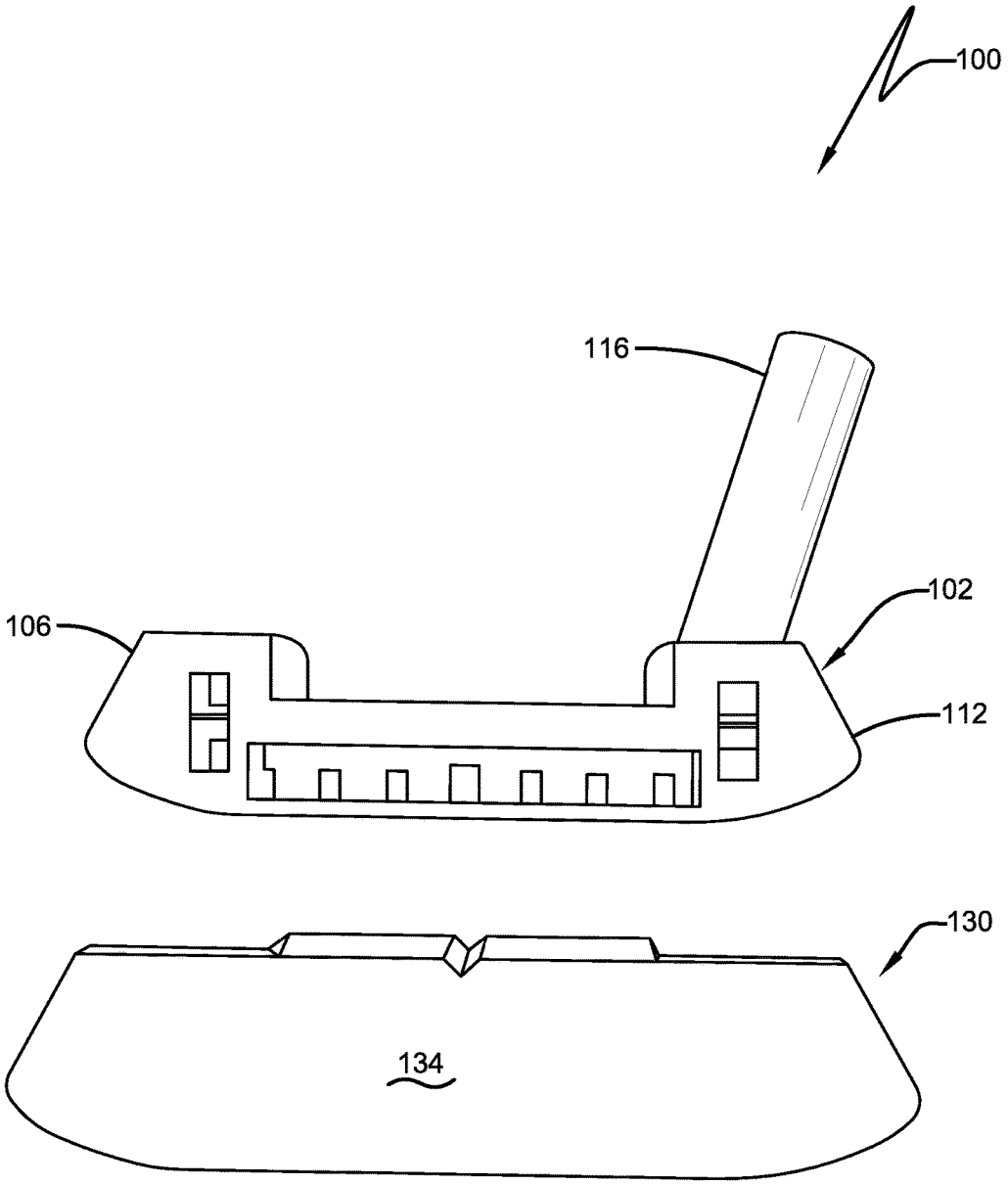
FIG. 3 illustrates an exploded front view of the golf club head in accordance with the disclosed architecture.
Figure 4:
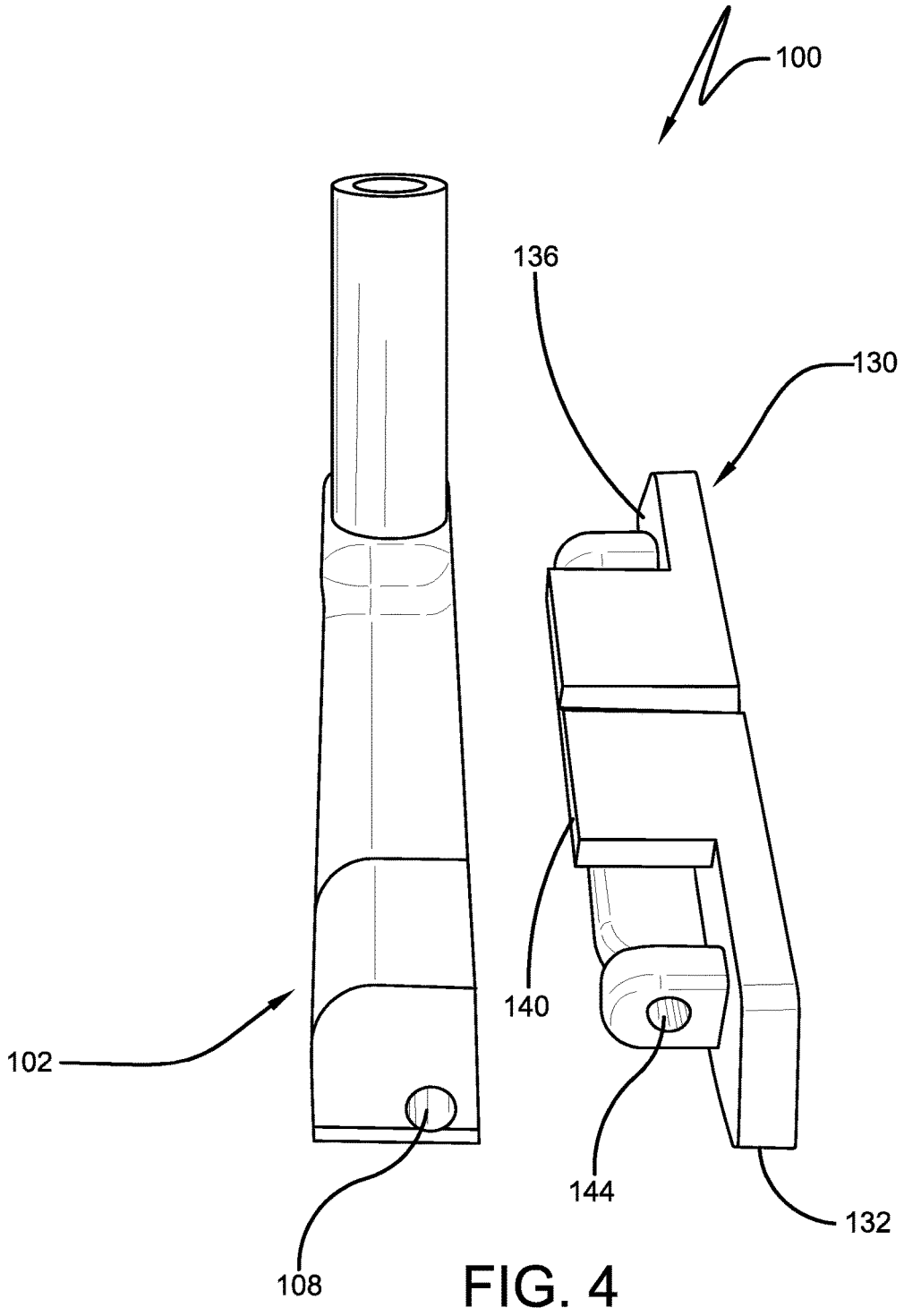
FIG. 4 illustrates an exploded view of a toe end of the golf club head in accordance with the disclosed architecture.
Figure 5:
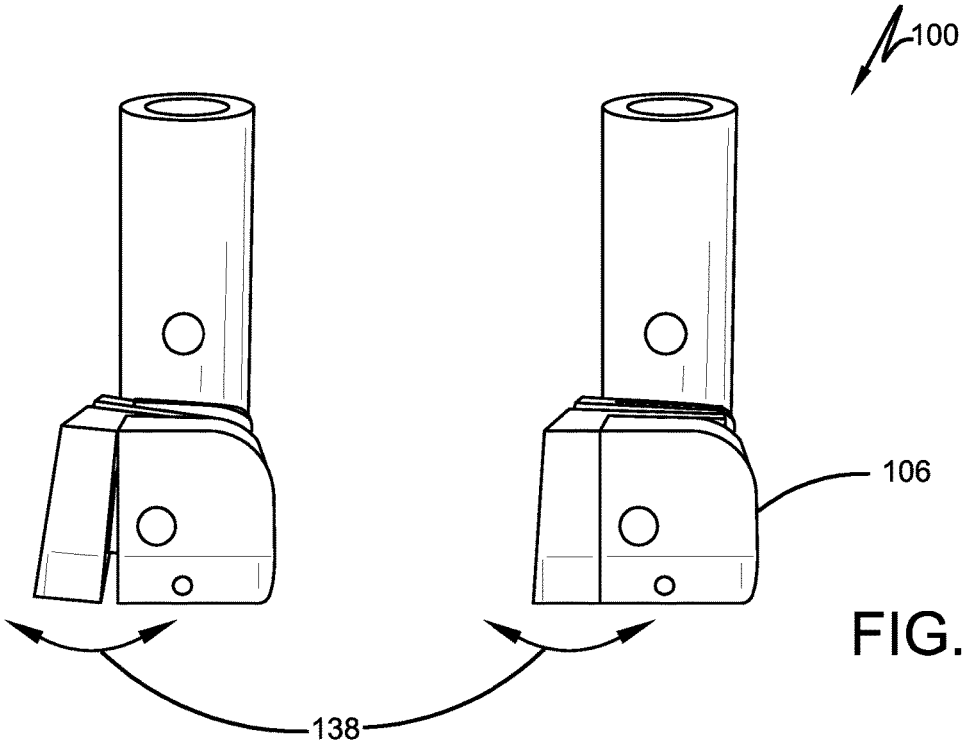
FIG. 5 illustrates an exploded view of the toe end of the golf club head in accordance with the disclosed architecture.
Figure 6:
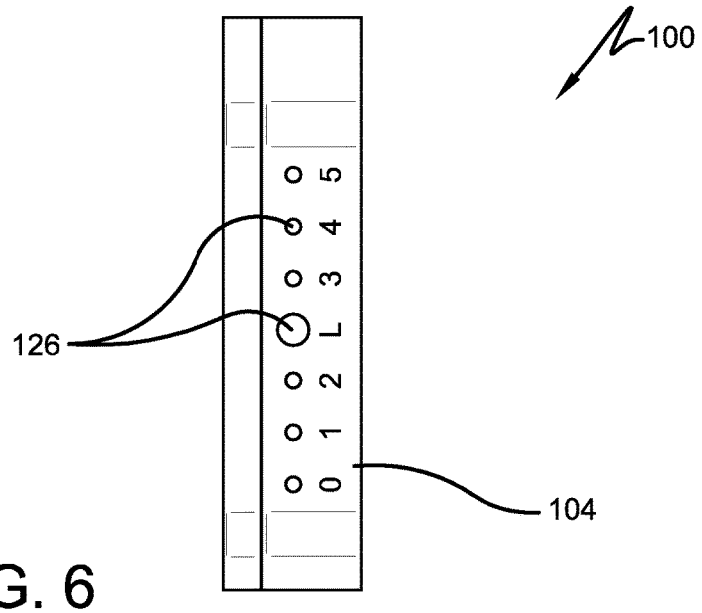
FIG. 6 illustrates a bottom view of the golf club head in accordance with the disclosed architecture.
Figure 7:
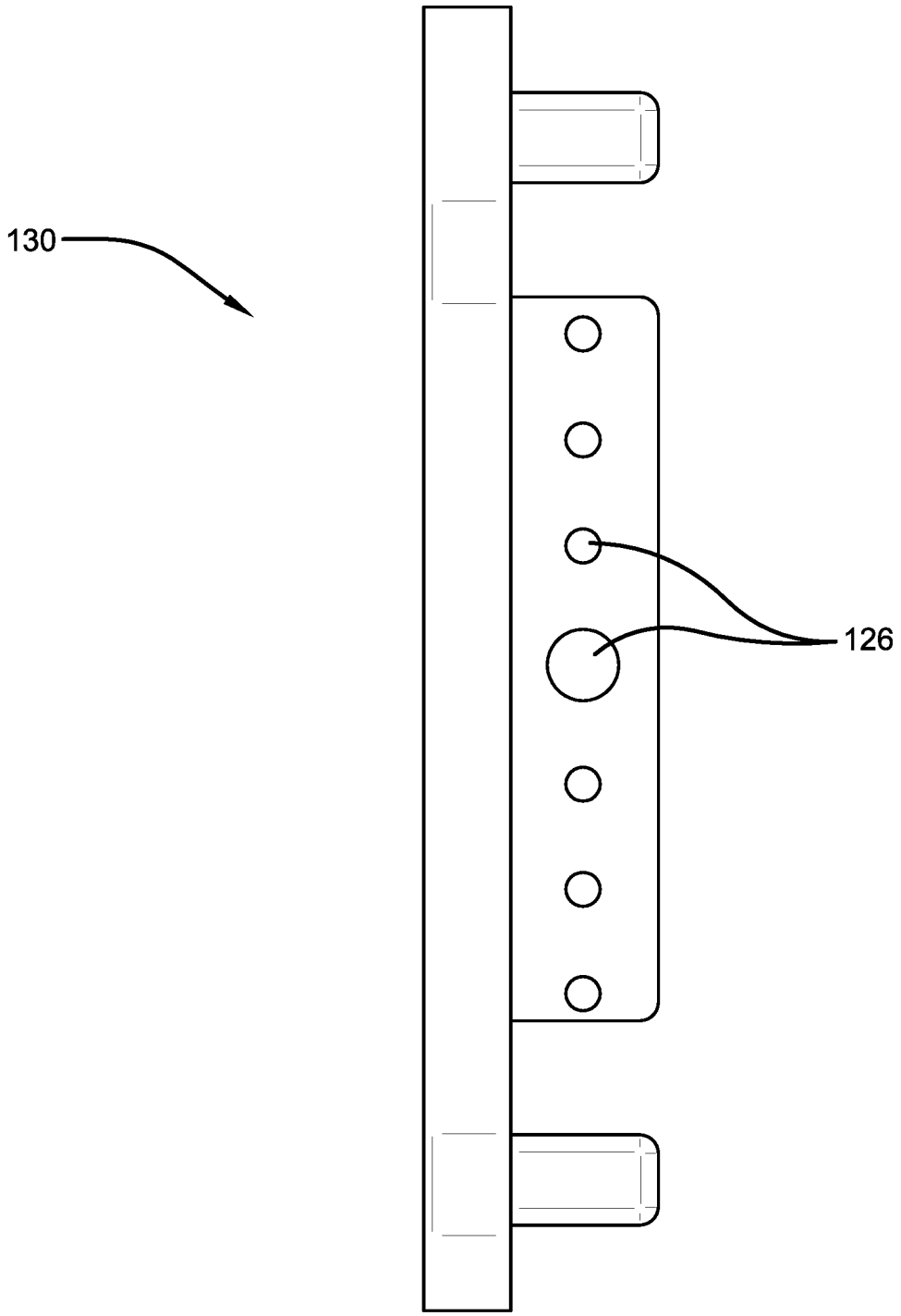
FIG. 7 illustrates a bottom view of a face component of the golf club head in accordance with the disclosed architecture.
Figure 8:
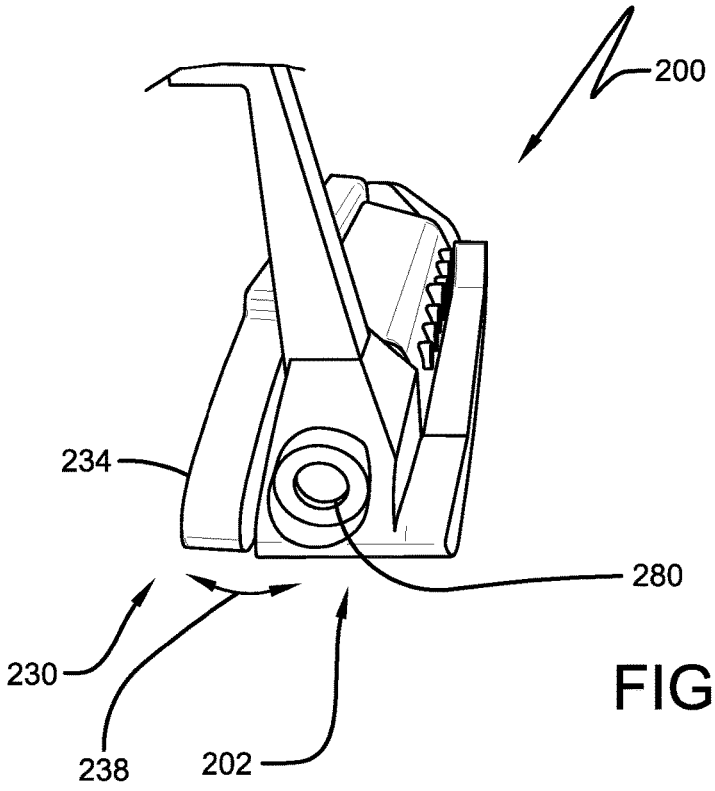
FIG. 8 illustrates a perspective view of a golf club head in accordance with the disclosed architecture.
Figure 9:
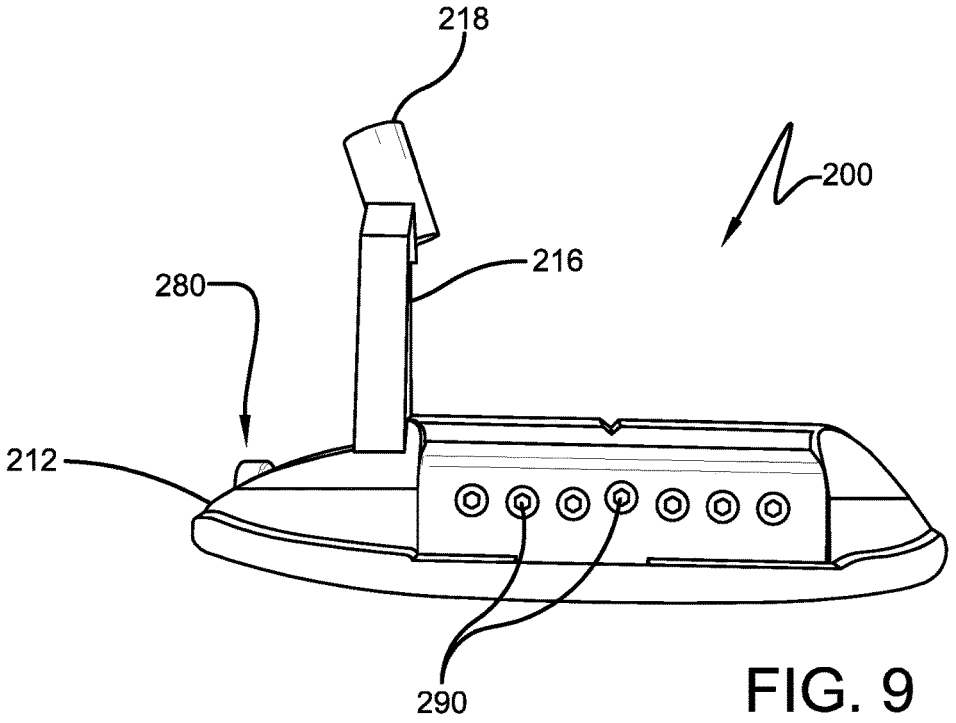
FIG. 9 illustrates a rear view of the golf club head in accordance with the disclosed architecture.
Figure 10:
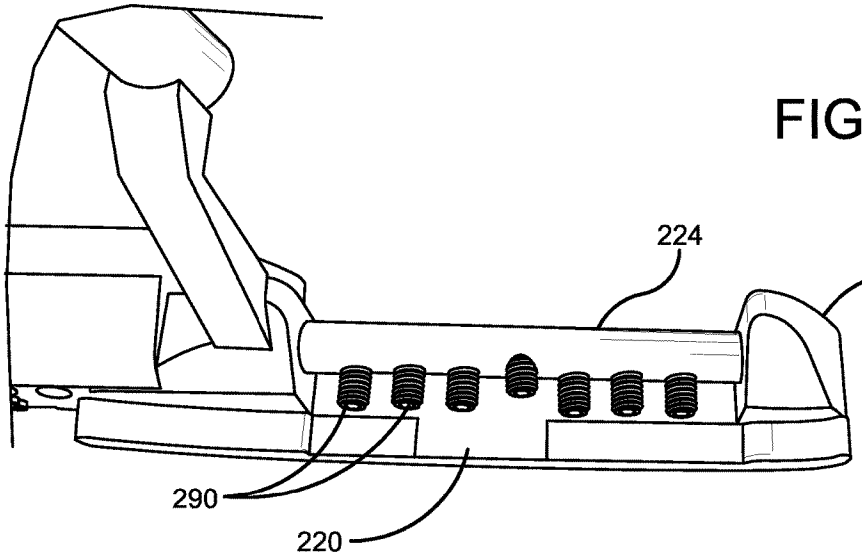
FIG. 10 illustrates a perspective view of a housing component the golf club head in accordance with the disclosed architecture.
Figure 11:
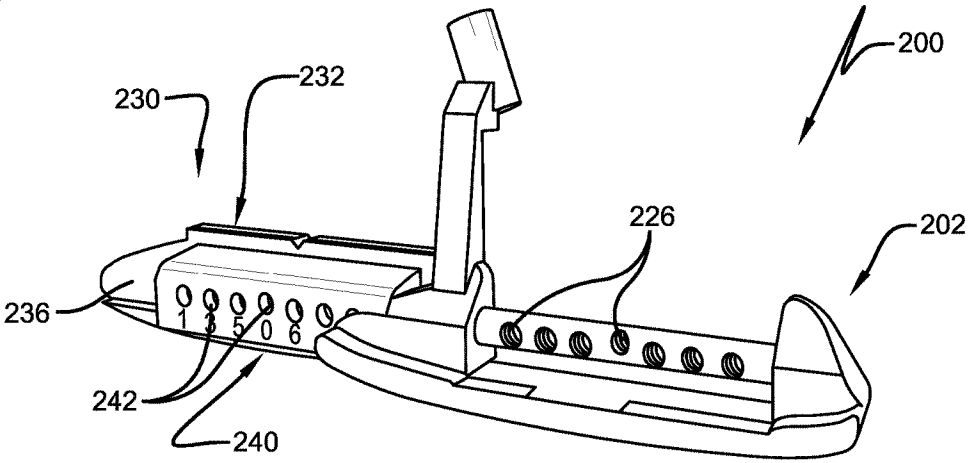
FIG. 11 illustrates an exploded view of the golf club head in accordance with the disclosed architecture.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter. The invention relates generally to a golf putter club head that is adjustable in loft.

As illustrated in FIGS. 1-7, a golf club head 100 is disclosed. The golf club head 100 is attachable and securable to any golf club shaft as is known in the art. The golf club head 100 is preferably useable as a putter, but may be used as any other golf club if desired. A loft 138 of the golf club head 100 is modifiable by a user to fit a particular swing style, putting stroke or to accommodate a particular putting surface without the need for sophisticated monitoring or adjusting equipment.

The golf club head 100 comprises a housing component 102, a face component 130, a securing component 180, and a plurality of adjusting components 190. The housing component 102 comprises a sole 104, a toe 106, a heel 112, a center portion 116, and a shaft engaging portion 120. The center portion 120 connects the heel 112 to the toe 106. The sole 104 is the bottom surface of the housing component 102 and extends generally from the toe 106 through the heel 112. The shaft engaging portion 120 extends out of the heel 112 and comprises a hosel 118 for engaging and connecting to a golf club shaft (not shown). The golf club shaft may be manufactured in any length, style, or from any material useable for a golf club shaft as is known in the art.

The toe 106 comprises a toe hole 108 running laterally through at least a portion of the toe 106 from the center portion 120 outward. The toe hole 108 may be threaded. The heel 112 comprises a heel hole 114 running laterally from the center portion 120 completely through the heel 112 and is oriented essentially in line with the toe hole 108. The toe hole 108 and the heel hole 114 are dimensioned so as to receive the securing component 180 as described infra. The center portion 120 is configured to receive the face component 130 as described infra. The center portion 120 comprises a plurality of loft adjusting holes 126 for receiving the plurality of adjusting components 190. The plurality of loft adjusting holes 126 penetrate the center portion 120 and may be aligned in a square, rectangular, or linear arrangement or any other pattern as is desirable. The plurality of loft adjusting holes 126 are configured to accept the plurality of adjusting components 190. Typically, the plurality of loft adjusting holes 126 are threaded, but may also be configured to engage any other type of fixing component as is known in the art as well.

The face component 130 comprises a blade 132 and a housing component engaging portion 140 that is attachable to housing component 102. The blade 132 comprises a face 134 for striking a golf ball and a back 136. The housing component engaging portion 140 is attached to and extends out of the back 136 of the blade 132 and is dimensioned to fit in a space adjacent to the center portion 120 of the housing component 102 between the heel 112 and the toe 106. The housing component engaging portion 140 comprises a plurality of receiving ports 142 and a securing component hole 144. The plurality of receiving ports 142 are adapted to align with the plurality of loft adjusting holes 126 the housing component 102. The securing component hole 144 runs approximately laterally through the housing component engaging portion 140 and is essentially in line with the toe hole 108 and the heel hole 114 once the housing component engaging portion 140 is placed atop the center portion 120 of the housing component 102.

The plurality of adjusting components 190 may be set screws, however this is not meant as a limitation as they may also comprise any other type of adjustable fastener as is known in the art. The plurality of adjusting components 190 are insertable within the housing component 102 extending through the plurality of loft adjusting holes 126 from the sole 104 upward and into the plurality of receiving ports 142 in the face component 130. Each individual adjusting component is configured engage the face component 130 to adjust the loft 138 of the face component 130 relative to the housing component 102 to a different degree. The loft 138 may be adjustable to any degree as permitted by the United States Golf Association rules for golf clubs which are hereby incorporated by reference. Each individual adjusting component mates with its corresponding receiving port which fixes that particular degree of loft. For example, the adjusting components may vary in loft adjustment by 0.25, 0.5, 0.75, and 1.0 degrees, or by any other interval desirable. In one embodiment shown in FIG. 5, the interval in the loft adjusts from between 0 and 4 degrees in 0.5 degree increments.

To adjust the loft 138, the user rotates the appropriate set screw with a screw driver, wrench, or the like, thereby pushing out a bottom of the blade 132 to achieve the corresponding loft 138. The blade 132 rotates freely until the screw is fully tightened to that particular degree of loft. Once the desired loft 132 is set, the securing component 180 is secured within the toe hole 108, the securing component hole 144, and the heel hole 114. The securing component 180 is typically a pin, a rod, a shaft or the like, comprising a threaded end 182 and a tightening end 184. The threaded end 182 engages the toe hole 108 and the tightening end 184 extends from the heel end 112. To secure the face component 130 to the housing component 102 once the loft 138 is adjusted, the user rotates the tightening end 184 with a screw driver, wrench, or the like so the securing component 180 is temporarily fixed in place at the desired degree of loft 138.

In an alternative embodiment illustrated in FIGS. 8-11, an adjustable golf club head 200 comprises a housing component 202, a face component 230, a securing component 280, and a plurality of adjusting components 290. The housing component 202 comprises a toe 206, a heel 212, a center portion 216, and a shaft engaging portion 220. The center portion 220 of the housing component 202 further comprises a base element 222 and a back element 224. The base element 220 is configured to receive the face component 220 in a similar manner as in the previous embodiment where the face component 130 engaged the center portion 120. The back element 224 extends upward approximately perpendicular to the base element 222 so that the center portion 220 essentially forms an L-bar shape. The back element 224 comprises a plurality of loft adjusting holes 226 that penetrate the back element 224 and may be aligned in a square, rectangular, or linear arrangement or any other pattern as is desirable. The plurality of loft adjusting holes 226 are configured to accept the plurality of adjusting components 290.

The face component 230 comprises a blade 232 and a housing component engaging portion 240 that is attachable to housing component 202. The blade 232 comprises a face 234 for striking a golf ball and a back 236. The housing component engaging portion 240 is attached to and extends out of the back 236 of the blade 232 and is dimensioned to fit in a space adjacent to the center portion 220 of the housing component 202 between the heel 212 and the toe 206. The housing component engaging portion 240 comprises a plurality of receiving ports 242 and a securing component hole 244. The plurality of receiving ports 142 are adapted to align with the plurality of loft adjusting holes 226 the back element 224 of the housing component 202. The securing component hole 244 runs approximately laterally through the housing component engaging portion 240.

The plurality of adjusting components 290 may be set screws, however this is not meant as a limitation as they may also comprise any other type of adjustable fastener as is known in the art. The plurality of adjusting components 290 are insertable approximately in a horizontal orientation within the housing component 202 extending through the plurality of loft adjusting holes 226 from the rear inward and into the plurality of receiving ports 242 in the face component 230. Each individual screw is configured engage the face component 230 to adjust a loft 238 of the face component 230. While the loft 238 is typically adjustable from between zero and six degrees, this is not meant as a limitation as the loft 238 could be set to any desired angle including negative angles.

Once the desired loft 232 is set, the securing component 280 is secured within the toe 206, the securing component hole 244, and the heel 212. The securing component 280 is typically a pin, a rod, a shaft or the like, comprising a threaded end 282 and a tightening end 284. The threaded end 282 engages the toe 206 and the tightening end 284 extends inward from the heel 212 to secure the face component 230 to the housing component 202.

Figure 12:
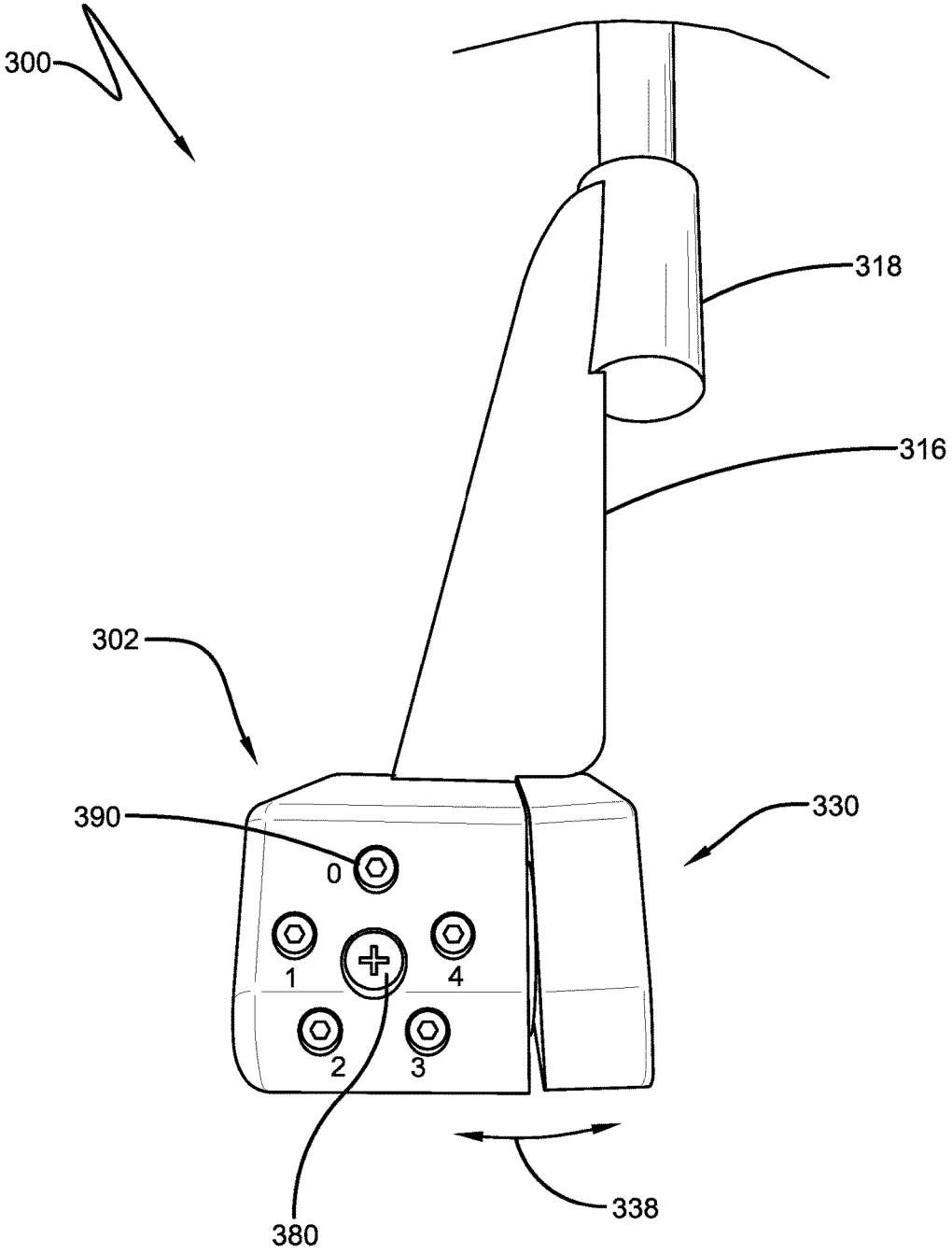
FIG. 12 illustrates a perspective view of a golf club head in accordance with the disclosed architecture.
Figure 13:
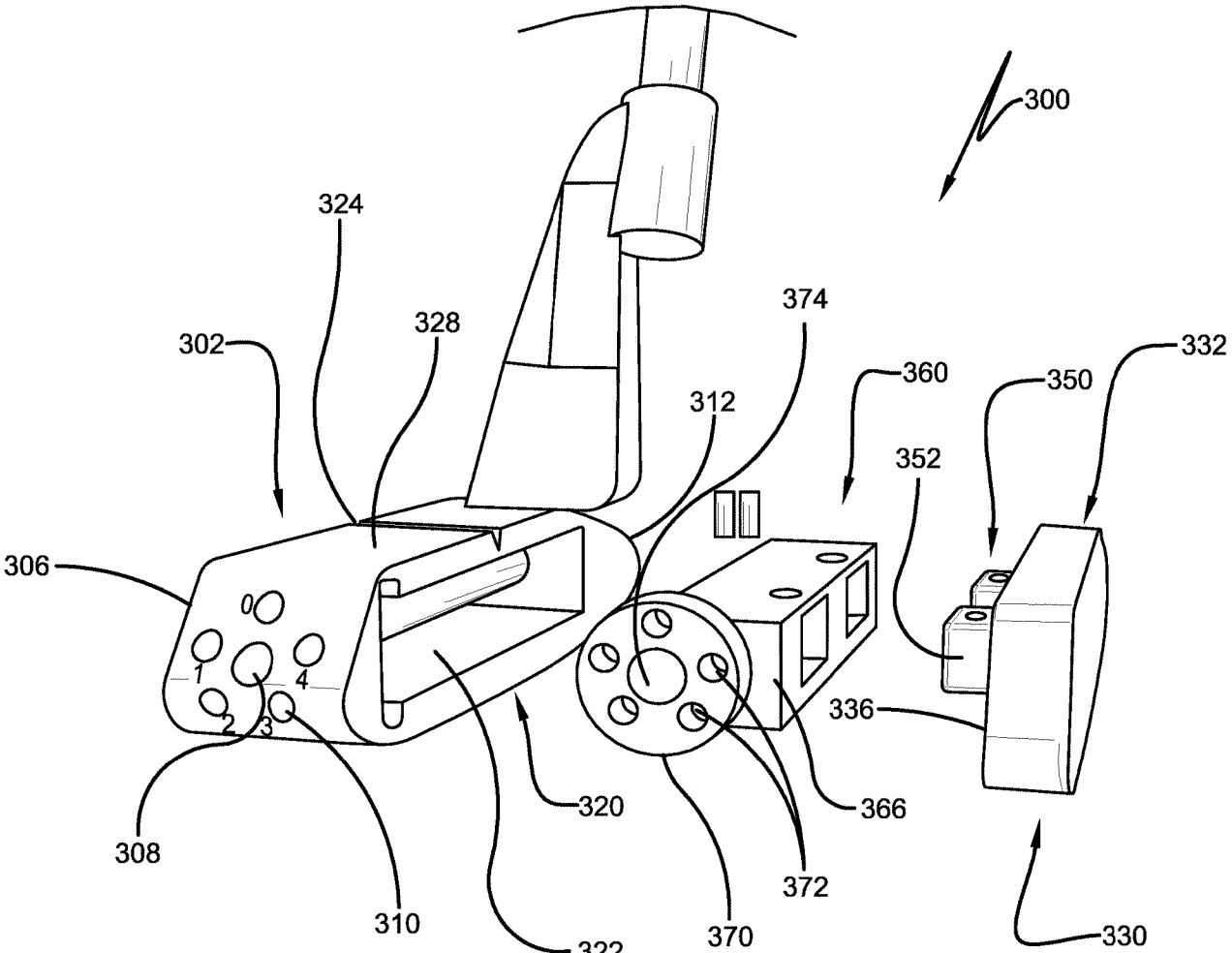
FIG. 13 illustrates an exploded view of a toe end of the golf club head in accordance with the disclosed architecture.
Figure 14:
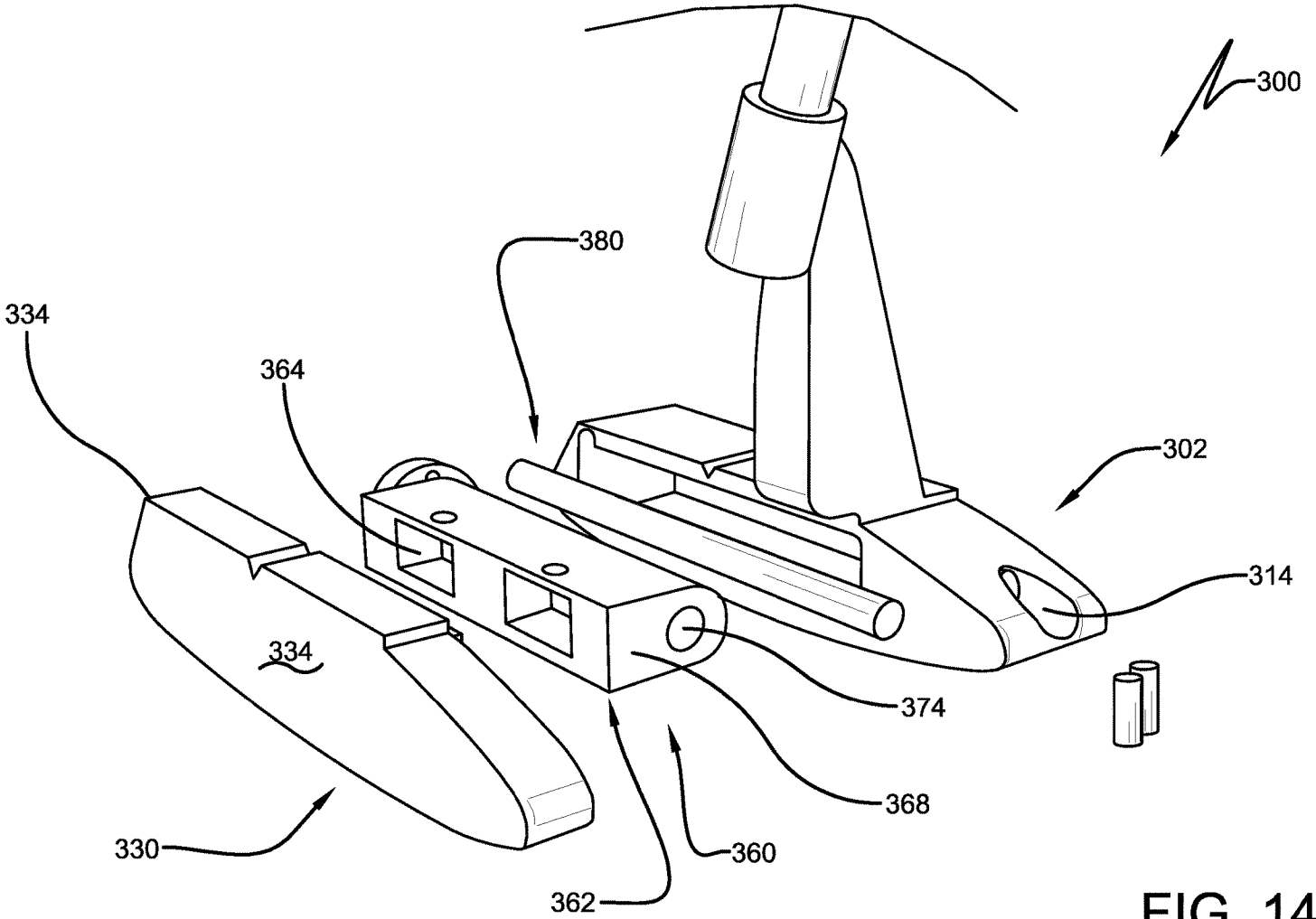
FIG. 14 illustrates an exploded view of a heel end of the golf club head in accordance with the disclosed architecture.

In an alternative embodiment illustrated in FIGS. 12-14, an adjustable loft golf club 300 head comprises a housing component 302, a face component 330, a cylinder component 360, a securing component 380, and a plurality of adjusting components 390. The housing component 302 comprises a toe 306, a heel 312, a center portion 320, and a shaft engaging portion 316. The center portion 320 connects the heel 312 to the toe 306. The toe 306 comprises a toe hole 308 running laterally penetrating the toe 306 and a plurality of loft adjusting holes 301 that loop around or surround the toe hole 308 and similarly penetrate the toe 306 approximately laterally. The heel 312 comprises a heel hole 314 running laterally from the center portion 320 completely through the heel 312 and is essentially in line with the toe hole 308. The toe hole 308 and the heel hole 314 are dimensioned so as to receive the securing component 380. The center portion 320 is approximately rectangular in configuration and comprises a base element 322, a back element 324 extending upward approximately perpendicular to the base element 322, and a top element 328 oriented approximately parallel with the base element 322 extending inward approximately perpendicular to the back element 324.

The face component 330 comprises a blade 332 and a cylinder component engaging portion 350. The blade 332 comprises a face 334 for striking a golf ball and a back 336. The cylinder component engaging portion 350 extends out of the back 336 of the blade 332.

The cylinder component 360 comprises a body portion 362, a rotational portion 370, and a securing component hole 374. The body portion 362 is generally rectangular in shape and is dimensioned to fit within the center portion 320 of the housing component 302. The securing component hole 374 penetrates both the body portion 362 and the rotational portion 370.

The body portion 362 comprises a toe end 366, a heel end 368, and a face component engaging portion 364 that connects the toe end 366 and the heel end 368. The face component engaging portion 364 is generally substantially hollow and is configured to receive the cylinder component engaging portion 350 of the face component 330. However, the face component engaging portion 364 may be solid or honeycombed as well. Once the cylinder component engaging portion 350 is positioned into the face component engaging portion 364, they are secured to together with fasteners such as set screws, or any other type of fastener as is known in the art. Once the cylinder component 360 is secured to the face component 330, the body portion 362 of the cylinder component 360 is placed into the center portion 320 of the housing component 302. The rotational component 370 is generally circular or wheel shaped and is attached to the toe end 366 of the body portion 362 so that the rotational component 370 is slightly off set. The rotational component 370 comprises a plurality of receiving ports 372 located at intervals to correspond with the plurality of loft adjusting holes 310 that loop around the toe hole 308.

The plurality of adjusting components 390 are typically set screws, however this is not meant as a limitation as they may be any other type of adjustable fastener as is known in the art. The plurality of adjusting components 390 extend inward through the plurality of loft adjusting holes 310 in the toe 306 and engage the appropriate corresponding receiving port 372 in the rotational component 370. Each individual screw adjusts a loft 338 of the face component 330 to a different degree by rotating the cylinder component 360 within the housing component 302 and thereby rotating the face component 330 simultaneously.

To adjust the loft 338, the user rotates the appropriate set screw with a screw driver, wrench, or the like, thereby pushing out a bottom of the blade 332 to achieve the corresponding loft. The blade 332 rotates freely until the screw is fully tightened to that particular degree of loft. Once the desired loft is set, the securing component 380 is secured within the toe hole 308, the securing component hole 374, and the heel hole 314. The securing component 380 is typically a pin, a rod, a shaft or the like. The securing component 380 enters the toe hole 308 and extends inward through the heel 312.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A golf club head for use with a golf club shaft, the golf club head comprising:

a housing component comprising a toe, a heel, a center portion connecting the toe and the heel, and a sole extending along a bottom surface of the housing component between the toe and the heel;

a face component comprising a blade and a housing component engaging portion attached to the blade and the housing component, wherein a loft of the blade in relation to the golf club shaft is adjustable; and a plurality of adjusting components insertable into the housing component through the sole for engaging and repositioning the housing component engaging portion of the face component to adjust the loft of the blade by pushing a bottom of the blade away from the housing component; and a securing component comprising a threaded end and a tightening end for securing the face component to the housing component once the loft is adjusted; and wherein the toe comprises a toe hole extending laterally through at least a portion of the toe dimensioned to receive the securing component.

2. The golf club head of claim 1, wherein the adjusting components are set screws.

3. The golf club head of claim 1, wherein the center portion comprises a plurality of loft adjusting holes that penetrate the center portion through the sole for accepting the plurality of adjusting components.

4. The golf club head of claim 1, wherein the blade comprises a face and a back, and the housing component engaging portion is attached to the back of the blade.

5. The golf club head of claim 4, wherein the housing component engaging portion comprises a plurality of receiving ports adapted to align with the plurality of loft adjusting holes of the center portion of the housing component, wherein the receiving ports are configure to push out the bottom of the blade away from the housing component to adjust the loft as the adjusting components are inserted.

6. An adjustable golf club head for use with a golf club shaft, the adjustable golf club head comprising:

a housing component comprising a toe, a heel, and a center portion connecting the toe and the heel; and a face component comprising a blade comprising a face and a back; and a housing component engaging portion extending from the back of the blade for engaging the housing component; and wherein a loft of the blade in relation to the golf club shaft is adjustable; and a plurality of adjusting components insertable into the housing component for engaging and repositioning the housing component engaging portion of the face component to adjust the loft of the blade by pushing a bottom of the blade away from the housing component; and a securing component comprising a threaded end and a tightening end for securing the face component to the housing component once the loft is adjusted; and wherein the toe comprises a toe hole extending laterally through at least a portion of the toe dimensioned to receive the securing component.

7. The golf club head of claim 6, wherein the center portion comprises a base element and a back element extending substantially perpendicularly from the base element.

8. The golf club head of claim 7, wherein the back element comprises a plurality of loft adjusting holes that penetrate the back element for accepting the plurality of adjusting components.

9. The golf club head of claim 8, wherein the housing component engaging portion of the face comprises a plurality of receiving ports adapted to align with the plurality of loft adjusting holes of the back element of the center portion of the housing component.

10. The golf club head of claim 9, wherein the adjusting components are oriented substantially horizontally.

11. The golf club head of claim 10, wherein the adjusting components are set screws.

12. The golf club head of claim 11, wherein the loft of the face component is adjustable between zero and six degrees.

13. An adjustable loft golf club head for use with a golf club shaft, the adjustable loft golf club head comprising:

a housing component comprising a toe, a heel, and a center portion connecting the toe and the heel; and a cylinder component positional substantially within the housing component, comprising a body portion and a rotational portion substantially circular in configuration attached to the body portion, wherein the body portion is substantially rectangular in configuration and dimensioned to fit within the center portion of the housing component; and a face component comprising a blade comprising a face and a back; and a cylinder component engaging portion extending from the back of the blade; and wherein a loft of the face component in relation to the golf club shaft is adjustable; and a plurality of adjusting components insertable into the housing component through the toe for engaging the circular rotational portion of the cylinder component thereby rotating the body portion of the cylinder component to adjust the loft by pushing out a bottom of the blade; and a securing component for securing the face component to the housing component once the loft is adjusted.

14. The golf club head of claim 13, wherein the toe comprises a plurality of loft adjusting holes that penetrate the toe.

15. The golf club head of claim 14, wherein the body portion of the cylinder component comprises a toe end, a heel end and a face component engaging portion connecting the toe end and the heel end.

16. The golf club head of claim 15, wherein the rotational portion of the cylinder component abuts the toe end of the body portion.

17. The golf club head of claim 16, wherein the rotational portion comprises a plurality of receiving ports adapted to align with the plurality of loft adjusting holes of the toe of the housing component.

18. The golf club head of claim 17, wherein the loft of the blade is adjustable as one of the plurality of adjustable components engages a corresponding one of the plurality of receiving ports of the rotational portion of the cylinder component.

19. The golf club head of claim 18, wherein the securing component comprises a threaded end and a tightening end.

* * * * *